United States Patent [19]

Ferm et al.

[11] 4,435,273

[45] Mar. 6, 1984

[54] HEAT EXCHANGER ANTIFOULANT

[75] Inventors: Richard L. Ferm, Lafayette; Louis R. Kray, Novato, both of Calif.

[73] Assignee: Chevron Research Company, San Francisco, Calif.

[21] Appl. No.: 401,438

[22] Filed: Jul. 23, 1982

[51] Int. Cl.[3] ..... C10G 9/16

[52] U.S. Cl. ..... 208/48 AA; 252/51.5 R

[58] Field of Search ..... 208/48 AA; 252/51.5 R

[56] References Cited

U.S. PATENT DOCUMENTS 3,235,484 2/1966 Colfer ..... 208/48 AA 4,157,308 6/1979 Wilgus et al. ..... 252/515 R 4,200,518 4/1980 Mulvany ..... 208/48 AA 4,252,745 2/1981 Kwong et al. ..... 252/51.5 R

*Primary Examiner*—Delbert E. Gantz

*Assistant Examiner*—Anthony McFarlan

*Attorney, Agent, or Firm*—D. A. Newell; J. M. Whitney; J. J. DeYoung

[57] ABSTRACT

Disclosed is a process for reducing the fouling in a heat exchanger in which a hydrocarbon stream is heated or cooled as it passes through the heat exchanger. From 1 to 500 parts per million of an alkylamino alkylphenol is added to the stream to reduce fouling.

10 Claims, No Drawings

HEAT EXCHANGER ANTIFOULANT

BACKGROUND OF THE INVENTION

The invention relates to heat exchangers, particularly heat exchangers used in the processing of crude oil. More particularly, the invention relates to an additive for reducing heat exchanger fouling.

In the processing of petroleum, numerous heat exchangers are utilized to heat or cool process streams. Since refineries typically process very large quantities of petroleum ranging from 25,000 to 200,000 or more barrels per day, the heat exchangers in the refinery represent a very large capital investment. After a period of operation, deposits build up on the heat exchanger tubes greatly reducing heat exchanger efficiency and greatly increasing the energy consumed. Eventually, the heat exchanger must be taken out of operation and the tubes cleaned or replaced. Increasing heat exchanger efficiency and reducing the amount and rate of fouling can provide tremendous energy savings in refineries and other facilities that use heat exchangers.

DESCRIPTION OF THE PRIOR ART

Numerous heat exchanger antifoulant additives are well known in the art, for example, U.S. Pat. Nos. 3,437,583 and 3,442,791 which disclose as antifoulants for petroleum hydrocarbon streams the combination of a metal deactivator and a condensate product of an alkylphenol, polyamine, and formaldehyde. Similarly, U.S. Pat. No. 3,132,085 discloses the use of the condensation product of ammonium hydroxide, formaldehyde and an alkylphenol as a heat exchanger antifoulant.

SUMMARY OF THE INVENTION

A process for reducing heat exchanger fouling in which a liquid hydrocarbon stream is passed through a heat exchanger at a temperature from 0° to 1500° F. wherein from 1 to 500 parts per million of an antifoulant additive is added to said hydrocarbon stream, said additive comprising alkylamino alkylphenols of the formulae:

(I)

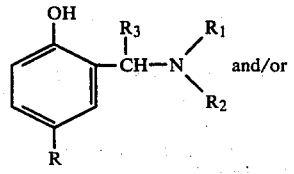

(II)

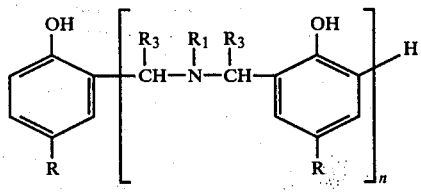

wherein: R and $R_1$ are independently alkyl groups of 1 to 20 carbon atoms; $R_2$ is H, or an alkyl group of 1 to 20 carbon atoms; $R_3$ is H, or an alkyl group of 1 to 6 carbon atoms; and n is 1 to 10.

DETAILED DESCRIPTION OF THE INVENTION

The heat exchangers utilized in the present invention are of any type where deposits accumulate on a heat transfer surface. The most common type of heat exchanger used is commonly known as a shell and tube heat exchanger.

The hydrocarbon stream passing through the heat exchanger is preferably a crude oil stream. Particularly preferred are petroleum stocks that contain reactive hydrocarbons such as olefins, sulfur, and nitrogen compounds. However, any hydrocarbon stream which leads to fouling of the heat exchanger can be utilized in the present invention, particularly various fractions of the crude oil. Generally, the streams passing through the heat exchanger will be heated or cooled at temperatures ranging from 0° to 1500° F., preferably 50° to 800° F.

The Alkylamino Alkylphenols

The alkylamino alkylphenol additives useful as antifoulants in the present invention have the general structure:

(I)

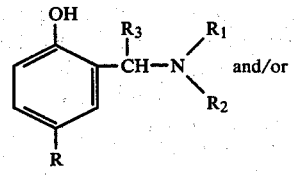

(II)

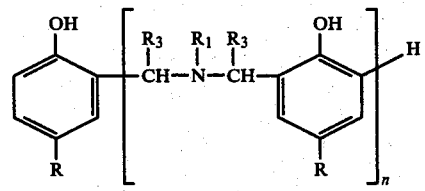

wherein: R and $R_1$ are independently alkyl groups of 1 to 20 carbon atoms; $R_2$ is H, or an alkyl group of 1 to 20 carbon atoms; $R_3$ is H, or an alkyl group of 1 to 6 carbon atoms; and n is 1 to 10. Representative alkyl groups include methyl, ethyl, dodecyl, octadecyl, octyl, and the like. These alkyl groups may be linear or branched.

Preferably, R is a branched alkyl group of 9 to 15 carbon atoms obtained by oligomerizing propylene, while $R_1$ is preferably a low molecular weight alkyl group such as methyl and $R_2$ is either hydrogen or another alkylphenolic methyl group. $R_3$ is preferably either hydrogen or a low molecular weight alkyl group, and more preferably $R_3$ is H. Preferably n is 1 to 4. Mixtures of the above types of compounds are contemplated and are particularly preferred.

Preparation of the Alkylamino Alkylphenols

The additives are obtained by the condensation reaction of an alkylphenol, an aldehyde and an amine. This reaction is well known in the art as the Mannich condensation reaction. Depending on the reactants, the ratio thereof, and reaction conditions, one or more of the above-described alkylamino alkylphenols is obtained.

The alkylated phenols useful in making the alkylamino alkylphenols used in this invention are of the formula:

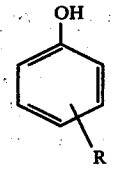

wherein R may be a straight or branched chain alkyl group having from 1 to 100 carbon atoms and preferably from 10 to 30 carbon atoms. The R groups or alkyl groups may be present on any or all of the sites around the phenolic ring, i.e., ortho, meta or para. Preferably, the R groups will be predominantly meta or para. That is, less than 40 percent of the R groups will be in the ortho position and preferably less than 15 percent of the R groups will be in the ortho position. A particularly preferred alkylated phenol is dodecylphenol.

Examples of suitable alkyls include octyl, decyl, dodecyl, ethylhexyl, triacontyl, etc.; radicals derived from petroleum hydrocarbons such as white oil, wax, olefin polymers (e.g., polypropylene, polybutylene, etc.), etc. While one specific structure is indicated by the above formula, it should be recognized that mixtures of alkylated phenols can be successfully employed.

Aldehydes having the following formula are suitable for use in the condensation reaction:

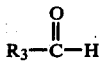

wherein $R_3$ is selected from hydrogen and alkyl radicals containing from 1 to 6 carbon atoms. Examples of suitable aldehydes including formaldehyde, acetaldehyde, propanaldehyde, butrylaldehyde, hexaldehyde and heptaldehyde. The most preferred aldehyde reactant is formaldehyde, which may be used in its monomeric or is polymeric form, such as paraformaldehyde.

The amines suitable for use in the condensation reaction contain one amino group and at least one active hydrogen atom. Suitable amines include primary amines and secondary amines. Examples include the primary alkyl amines such as methyl amine, ethyl amine, n-propyl amine, isopropyl amine, n-butyl amine, isobutyl amine, 2-ethylhexyl amine, dodecyl amine, stearyl amine, and the like. Also, dialkyl amines may be used, such as dimethyl amine, diethyl amine, methylethyl amine, methylbutyl amine, and the like. A preferred amine is methyl amine.

The condensation reaction will occur by simply warming the reactant mixture to a temperature sufficient to effect the reaction. The reaction will proceed at temperatures ranging from about 50° to 200° C. A more preferred temperature range is from 75° to 175° C. The time required to complete the reaction depends upon the reactants employed and the reaction temperature used. Under most conditions, reaction is complete in about 1 to 8 hours.

The amount of alkylated phenol, formaldehyde and amine present within the reaction medium generally ranges from 0.5 to 5 molar parts of primary amine and from 0.75 to 4 molar parts of formaldehyde per molar part of alkylated phenol. Preferably, the molar ratio of the phenol to the amine to formaldehyde varies from 1:1–4:2–3.5 and more preferably is from 1:1–1.5:2–3. Also, preferably, the reactants are chosen such that the total number of carbon atoms in the reaction product is less than 46 and more preferably less than 36.

To substantially reduce heat exchanger fouling, an effective amount, generally from 1 to 500 parts per million, preferably 5 to 99 parts per million, and most preferably 10 to 49 parts per million of the above-described alkylamino alkylphenol is added to the stream passing through the heat exchanger. One surprising feature of the present invention resides in the finding that such small quantities of the above-described additive are effective in reducing heat exchanger fouling.

EXAMPLE 1

Preparation of the Alkylamino Alkylphenols

This example is presented to illustrate preparation of one of the additives of the present invention.

Into a stainless steel vessel equipped with a vacuum distillation system is placed 60.4 parts of polypropylene phenol wherein the polypropylene has from 12 to 15 carbon atoms. The polypropylene phenol normally has approximately 5 percent of dialkylphenols. The vessel is evacuated to 250 mm mercury absolute pressure and the vacuum released with nitrogen. The vessel is again evacuated to 250 mm mercury absolute pressure and the vacuum again released with nitrogen. The vessel is then opened to the atmosphere while the nitrogen purge is maintained in the vapor space. Thereafter, 16.3 parts of isobutyl alcohol are charged to the vessel with agitation followed by 14.6 parts of paraformaldehyde. The vessel is closed and 7.25 parts of liquid monomethylamine are charged to the vessel over a period of three hours with constant agitation. The temperature of the vessel is maintained between 120° F. and 150° F. during the addition of the monomethylamine. The mole ratio of alkylphenol to monomethylamine to formaldehyde is approximately 1:1.05:2, respectively.

The reactor charge is mixed for 15 minutes after addition of the amine has been completed and is then vented. The temperature is raised to 190° F., the vessel closed and the temperature raised to 275° F. The reaction is carried out for five hours at a pressure of about 20 psig. The intermediate condensation product formed is then cooled in the vessel to about 180° F. and a quantity of mid-continent 100 neutral oil equal to 39.7 percent by weight of the previously charged constituents is added, i.e., 39.7 parts of the oil is added to the 100 parts already in the reactor. A quantity of water equal to 19.5 percent by weight of the original 100 parts charged is charged to the vessel and the system mixed for 15 minutes at a temperature of 170° to 180° F.

The mixer is then shut off and the system allowed to settle for about one hour. The water layer is then drawn off until an emulsion cuff appears. The system is then allowed to settle for about one-half hour and the water layer is again drawn off until a heavy cuff appeared. The above-described washing procedure is repeated using 16.5 parts of water. The product is the Mannich condensation reaction product of polypropylene phenol, paraformaldehyde and monomethylamine in an oil diluent.

EXAMPLES 2–9

Antifouling Tests

A mixture of alkylamino alkylphenols prepared from the condensation of dodecylphenol, paraformaldehyde and monomethylamine similar to that illustrated in Example 1 was tested for its antifouling characteristics using a standard ALCOR Test Apparatus and various test stocks. This test involves feeding a test stock material at a fixed rate and for a fixed period of time and at constant inlet temperature into a tube containing a stainless steel electrically heated rod while supplying enough heat to the rod to maintain the outlet temperature of the test stock constant. As fouling deposits form on the rod, the temperature of the rod must be increased to maintain a constant outlet temperature of the test stock. The initial rod temperature and final rod temperature are measured along with the initial and final weight of the rod. The increase in rod temperature and the amount of deposits on the rod are indicative of the degree and rate of fouling.

Each test run was for three hours and either no additive was used or 50 parts per million of additive was added to the test stock. The inlet temperature of the test stock was maintained at 70° F. and the outlet temperature was maintained at either 500° or 600° F. as indicated. The results are shown below in Table I.

TABLE I

| Test No. | Test Stock and Additive | Test Stock Outlet Temperature, °F. | ΔT, °F. | Deposit Wt, mg |
|---|---|---|---|---|
| | Jet Feed to Hydrofiner | | | |
| 1 | No Additive | 600 | −2 | 2.8 |
| 2 | Alkylamino alkylphenol | 600 | −2 | 0.5 |
| | Naphtha Feed to Hydrotreater | | | |
| 3 | No Additive | 600 | 4 | 15.3 |
| 4 | Alkylamino 600 alkylphenol | 16 | 0.5 | |
| | Jet Feed to Hydrofiner | | | |
| 5 | No Additive | 600 | 3 | 3.0 |
| 6 | 50 ppm Pyrole | 600 | 37 | 5.1 |
| 7 | 50 ppm Pyrole and 50 ppm alkylamino alkylphenol | 600 | 3 | 1.5 |
| | Western Wyoming Crude | | | |
| 8 | No Additive | 500 | 11 | 6.0 |
| 9 | Alkylamino alkylphenol | 500 | 10 | 0 |

What is claimed is:

1. A process for reducing heat exchanger fouling in which a liquid hydrocarbon stream is passed through a heat exchanger at a temperature from 0° to 1500° F. wherein from 1 to 500 parts per million of an antifouling additive is added to said hydrocarbon stream, said additive comprising an alkylamino alkylphenol of the formulae:

(I)

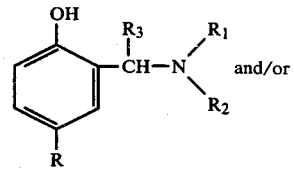

(II)

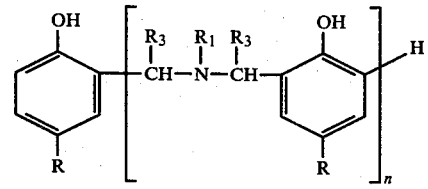

wherein: R and $R_1$ are independently alkyl groups of 1 to 20 carbon atoms; $R_2$ is H, or an alkyl group of 1 to 20 carbon atoms; $R_3$ is H, or an alkyl group of 1 to 6 carbon atoms; and n is 1 to 10.

2. The process of claim 1 wherein said stream is crude oil or a fraction thereof.

3. The process of claim 1 wherein in said formula R is an alkyl group of 9 to 15 carbon atoms.

4. The process of claim 3 wherein in said formula $R_1$ is methyl.

5. The process of claim 4 wherein in said formula $R_2$ is hydrogen or an alkylphenolic methyl group, $R_3$ is H, and n is 1 to 4.

6. The process of claim 5 wherein 5 to 99 parts per million of said additive is added to said stream.

7. The process of claim 1 wherein said hydrocarbon stream is passed through said heat exchanger at a temperature from 50° to 800° F.

8. The process of claim 1 wherein said alkylamino alkylphenol is made from the condensation of dodecylphenol, paraformaldehyde and methylamine.

9. The process of claim 8 wherein said heat exchanger is a shell and tube heat exchanger.

10. A process for reducing heat exchanger fouling in a shell and tube heat exchanger in which a liquid hydrocarbon stream is passed through a heat exchanger at a temperature from 50° F. to 800° F. wherein from 5 to 99 parts per million of an antifoulant additive are added to said hydrocarbon stream, said additive consisting essentially of the condensation product of dodecylphenol, paraformaldehyde and methylamine.

* * * * *